US010961084B2

(12) United States Patent
Scotto et al.

(10) Patent No.: US 10,961,084 B2
(45) Date of Patent: Mar. 30, 2021

(54) CLAMSHELL BUCKET WITH AUX-BAIL CARRIAGE ASSEMBLY

(71) Applicants: Anthony E. Scotto, Pittsburgh, PA (US); Kenneth James Platt, Youngstown, OH (US)

(72) Inventors: Anthony E. Scotto, Pittsburgh, PA (US); Kenneth James Platt, Youngstown, OH (US)

(73) Assignee: Taylor-Winfield Technologies, Inc., Youngstown, OH (US)

( * ) Notice: Subject to any disclaimer, the term of this patent is extended or adjusted under 35 U.S.C. 154(b) by 253 days.

(21) Appl. No.: 16/106,892

(22) Filed: Aug. 21, 2018

(65) Prior Publication Data

US 2019/0062126 A1 Feb. 28, 2019

Related U.S. Application Data

(60) Provisional application No. 62/549,635, filed on Aug. 24, 2017.

(51) Int. Cl.
*B66C 3/12* (2006.01)
*B66C 3/02* (2006.01)

(52) U.S. Cl.
CPC ..... *B66C 3/125* (2013.01); *B66C 3/02* (2013.01)

(58) Field of Classification Search
CPC ... B66C 3/02; B66C 3/12; B66C 3/125; E02F 3/47
USPC ..... 294/68.23; 37/461, 186, 187
See application file for complete search history.

(56) References Cited

U.S. PATENT DOCUMENTS

| | | | | | |
|---|---|---|---|---|---|
| 150,373 | A | * | 4/1874 | Symonds | |
| 263,230 | A | * | 8/1882 | Sargent | |
| 827,635 | A | * | 7/1906 | Hone | |
| 882,666 | A | * | 3/1908 | Chase | |
| 1,760,812 | A | * | 5/1930 | Carlson | B66C 3/12 37/184 |
| 2,587,217 | A | * | 2/1952 | Quenan | E02F 3/47 294/111 |
| 2,644,253 | A | * | 7/1953 | Salido | E02F 3/413 37/187 |
| 2,736,444 | A | * | 2/1956 | Smith | E02F 3/413 414/625 |
| 3,479,077 | A | * | 11/1969 | Spears | E02F 3/47 294/68.23 |
| 3,949,498 | A | * | 4/1976 | Iwata | B66C 3/02 37/187 |

* cited by examiner

*Primary Examiner* — Dean J Kramer
(74) *Attorney, Agent, or Firm* — Fay Sharpe LLP

(57) ABSTRACT

A crop bucket having an aux-bail release mechanism wherein movement of the chains is restrained such that an auxiliary hook actuating the release mechanism can do so in a smooth and controlled manner from a variety of angles and positions, while reducing or eliminating bucket roll from offset pulling. The release mechanism can include a carriage configured to translate along at least a portion of a mast and operatively connected to first and second clamshell portions such that movement of the carriage away results in rotation of the clamshell portions toward the open position.

13 Claims, 9 Drawing Sheets

CLAMSHELL BUCKET WITH AUX-BAIL CARRIAGE ASSEMBLY

CROSS REFERENCE TO RELATED PATENTS AND APPLICATIONS

This application claims priority to and the benefit of the filing date of U.S. Provisional Patent Application Ser. No. 62/549,635, filed Aug. 24, 2017, which application is hereby incorporated by reference.

BACKGROUND

Clamshell buckets are often used for transporting bulk and/or heavy materials within factories and other facilities. Clamshell buckets are also used in other settings as well. Such buckets generally have a bottom comprised of two clamshell portions that can be selectively pivoted away from each other to dump the contents of the bucket.

In one application, a clamshell bucket may be employed as a scrap bucket (also referred to as a crop bucket) in a casting operation for collecting and transporting of crops and/or other scrap material. Crops are generally deposited into the crop bucket in a random fashion which can often result in uneven loading of the crop bucket. Once full, the crop bucket can be lifted and transported to an unloading location by a crane having a main hook and an auxiliary hook. The main hook is used to lift and transport the crop bucket, and the auxiliary hook is used to actuate a release mechanism of the crop bucket configured to move the two clamshell portions of the crop bucket to a dumping position.

Typical release mechanisms rely on chains or cables connected to the clamshell portions of the crop bucket. The auxiliary hook is used to lift the chains via a chain support (also called an aux-bail) to thereby cause the clamshell portions to pivot away from each other thereby dumping the contents of the crop bucket. Prior art crop buckets can present challenges for safe and smooth operation in situations where the crop bucket is not loaded evenly, or in installations where the auxiliary hook imposes a rotating force to the crop bucket during actuation of the release member. The latter condition may occur, for example, when the auxiliary and main hooks of the crane are in a position 90 degrees from the axis about which the clamshell portions are configured to pivot, and/or when the auxiliary hook otherwise applies tension to the release mechanism along a vector that is not aligned to produce efficient rotation of each clamshell portion about its respective axis of rotation about which it pivots between a closed position and an open position.

BRIEF DESCRIPTION

In accordance with one aspect of the present exemplary embodiment, the present disclosure sets forth a crop bucket having a release mechanism wherein the movement of the chains is restrained such that an auxiliary hook actuating the release mechanism can do so in a smooth and controlled manner from a variety of angles, while reducing or eliminating bucket roll from offset pulling. To this end, the chains of the present disclosure, secured at first ends thereof to respective first and second clamshell halves, are fixed at second ends thereof to an aux-bail member, which in turn is mounted to a carriage configured to slide substantially vertically along a mast from which the entire bucket assembly is supported by the main hook of a crane. The carriage supports a pivoting arm to which the auxiliary hook can attach. The pivoting arm pivots from a first position facilitating connection of the auxiliary hook thereto (e.g., spaced further apart laterally from the carriage/mast), to a second position upon application of tension by the auxiliary hook. The tensile force applied by the auxiliary hook draws the carriage upwardly along the mast to thereby open the clamshell halves in a controlled manner. Removal of the tensile force allows the carriage to slide downwardly and the clamshell halves to close.

In accordance with one aspect, a clamshell bucket comprises a main body, first and second clamshell portions pivotally secured to the main body and moveable between a closed position for loading a material in the clamshell bucket and an open position for dumping material from the bucket, a bail coupled to the main body, a mast connected to the bail and configured for attachment to an associated crane for lifting and/or transporting the clamshell bucket, and a release mechanism configured for attachment to an auxiliary crane for moving the clamshell portions from the closed position to the open position. The release mechanism includes a carriage configured to translate along at least a portion of the mast from a location proximal the main body to a location distal the main body, the carriage being operatively connected to the first and second clamshell portions such that movement of the carriage away from the main body along the mast results in rotation of the clamshell portions toward the open position.

The bucket can further include an aux-bail with first and second linkages extending from opposite ends of the aux-bail and coupled to the first and second clamshell portions, the aux-bail being supported by the carriage at a location between the first and second linkages. The aux-bail can be pivotally connected to the carriage. A pivot arm can be connected to the carriage, the pivot arm having a distal end adapted to be engaged by an associated auxiliary crane. The pivot arm can be movable between a first position and a second position, wherein the distal end is spaced further from the mast in the first position than in the second position. The bail can include first and second arms pivotally attached to the main body, and a cross member extending between the first and second arms and connected to the mast, and the aux-bail can be coextensive with the cross member across a width of the main body. The mast can be pivotally connected to the cross member. The carriage can include at least one roller.

In accordance with another aspect, a release mechanism is provided that is configured for attachment to an associated auxiliary crane hook for moving respective clamshell portions of an associated clamshell bucket from a closed position to an open position, the associated clamshell bucket having a main body, first and second clamshell portions pivotally attached to the main body, and a mast extending from the main body for connection to a main crane hook. The release mechanism comprises a carriage mountable to the mast of the associated clamshell bucket for translating movement along at least a portion of the mast from a location proximal the main body of the bucket to a location distal the main body of the bucket, the carriage being operatively connectable to the first and second clamshell portions of the clamshell bucket such that movement of the carriage away from the main body along the mast results in rotation of the clamshell portions towards the open position.

The release mechanism can further include an aux-bail with first and second linkages extending from opposite ends of the aux-bail and coupled to the first and second clamshell portions of the associated clamshell bucket, the aux-bail being supported by the carriage at a location between the first and second linkages. The aux-bail can be pivotally connected to the carriage. A pivot arm can be connected to the carriage, the pivot arm having a distal end adapted to be engaged by an associated auxiliary crane. The pivot arm can be movable between a first position and a second position, wherein the distal end is spaced further from the mast of the associated clamshell bucket in the first position than in the second position. The carriage can include at least one roller.

In accordance with another aspect, a method of unloading a clamshell bucket comprises providing a clamshell bucket having a main body, first and second clamshell portions pivotally secured to the main body and moveable between a closed position for loading a material in the clamshell bucket and an open position for dumping material from the bucket, a bail coupled to the main body, a mast connected to the bail and configured for attachment to an associated crane for lifting and/or transporting the clamshell bucket, and a release mechanism configured for attachment to an auxiliary crane for moving the clamshell portions from the closed position to the open position, wherein the release mechanism includes a carriage configured to translate along at least a portion of the mast from a location proximal the main body to a location distal the main body, the carriage being operatively connected to the first and second clamshell portions such that movement of the carriage away from the main body along the mast results in rotation of the clamshell portions toward the open position, and causing said carriage to translate along said mast in direction away from the main body during an unloading process.

DETAILED DESCRIPTION

Figure 1A:
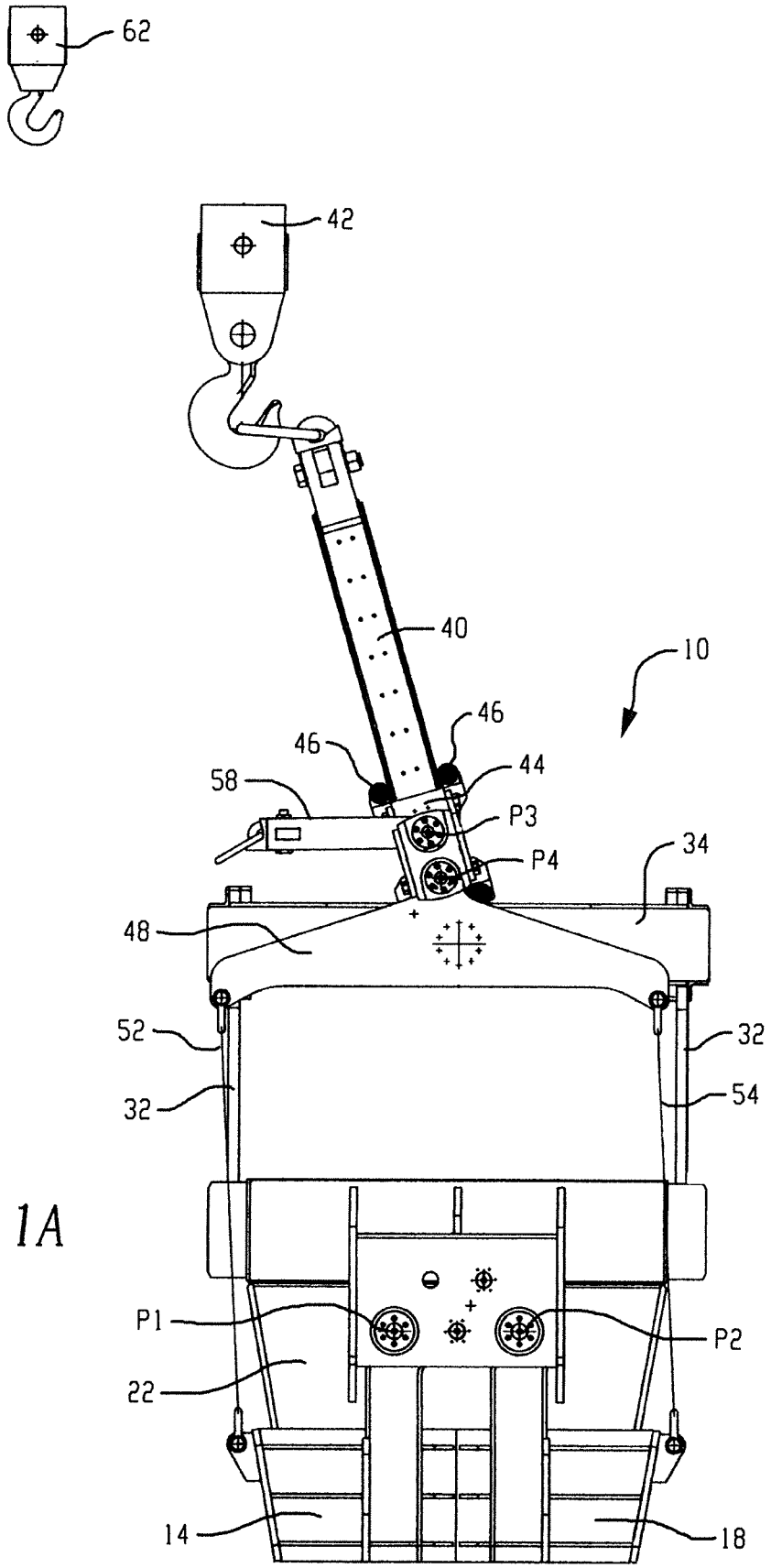
FIG. 1A is a front elevational view of an exemplary clamshell bucket in accordance with the present disclosure in a resting state.
Figure 1B:
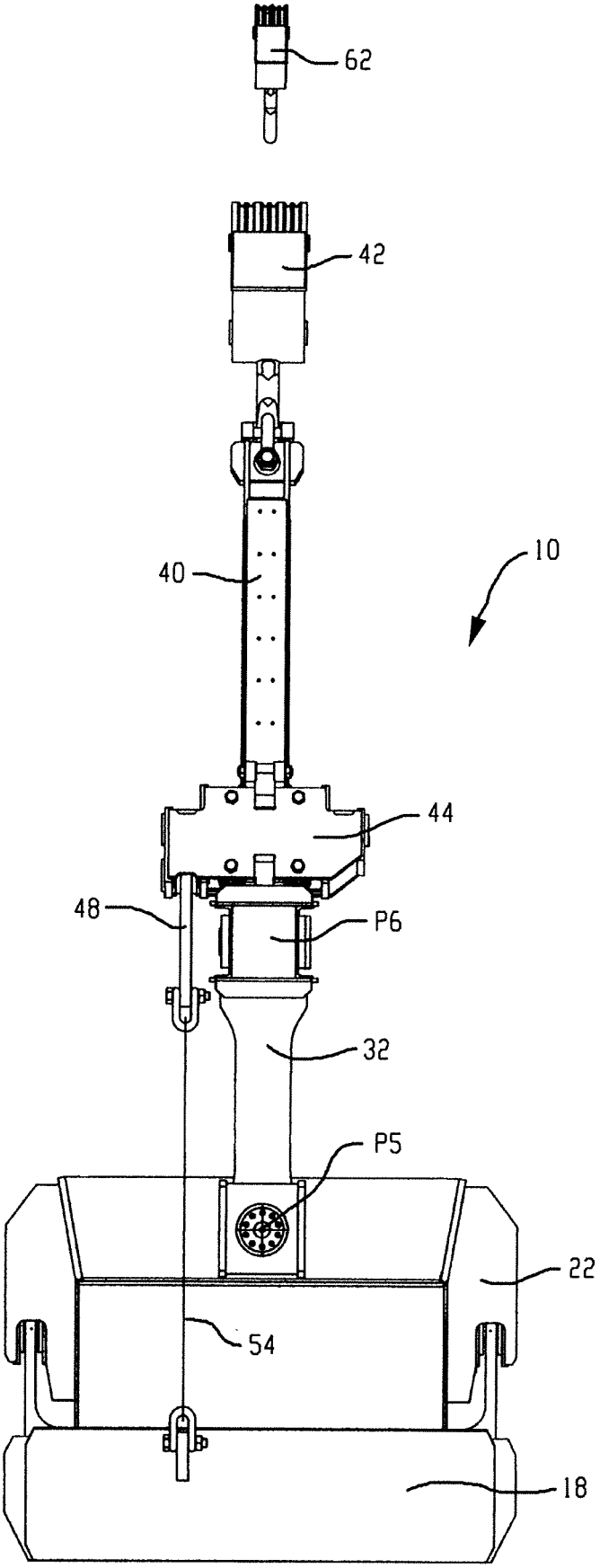
FIG. 1B is a side elevational view of the clamshell bucket of FIG. 1A.
Figure 1C:
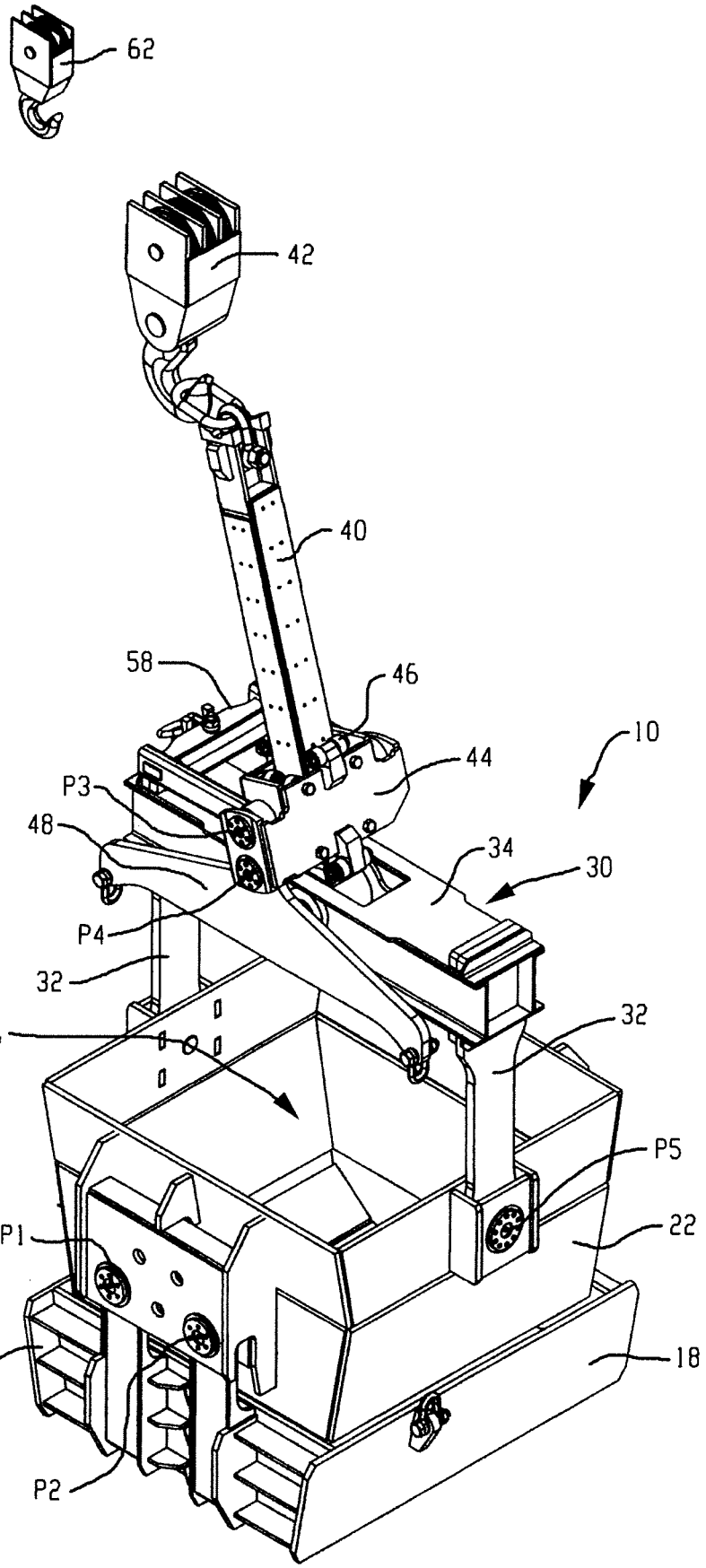
FIG. 1C is a perspective view of the clamshell bucket of FIG. 1A.

With initial reference to FIGS. 1A-1C, an exemplary clamshell bucket is illustrated and identified generally by reference numeral 10. In FIGS. 1A-1C the clamshell bucket 10 is shown in a resting state, such as may be the case during filling and/or just prior to lifting by an overhead crane or the like. The clamshell bucket 10 generally includes first and second clamshell portions 14 and 18 pivotally attached to a main body 22 at pivots P1/P2 (additional pivots located on back side not shown). All the pivots described herein can include suitable bearings, bushings or other structures for coupling components for relative rotation. For example, pivots P1/P2 couple the first and second clamshell portions 14 and 18 with the main body 22 for rotational movement between the illustrated closed positon, and an open position (see FIGS. 3A-3C). Together, the clamshell portions 14 and 18 and the main body 22 define a receptacle 26 for receiving material.

The main body 22 is supported by a bail 30. The bail 30 includes first and second arms 32 attached to a cross-member 34. Extending upwardly from the cross-member 34 is a mast 40. The mast 40 is adapted to be engaged by a main hook 42 for lifting the clamshell bucket 10. Mast 40 forms a substantially vertical rail during lifting by main hook 42.

With additional reference to FIGS. 2A-2C which illustrate the clamshell bucket 10 in a suspended state, such as after being lifted by an overhead crane, the aux-bail carriage in accordance with the present disclosure will be described. In this regard, supported for sliding movement relative to the mast 40, is a carriage 44. Carriage 44 includes a plurality of rollers 46 on each side of the mast 40 for facilitating smooth translation of the carriage 44 along the mast 40. The mast 40 may be fitted with guides or runners or other structure for facilitating movement of the carriage 44 along the mast 40. Carriage 44 is part of a release mechanism for opening the clamshell halves 14 and 18 that includes an aux-bail 48 to which first and second chains 52 and 54 are secured. First and second chains 52 and 54 are attached to respective clam-shall halves 14 and 18, and are used to draw the clamshell halves 14 and 18 from the closed position to the open position.

Figure 2A:
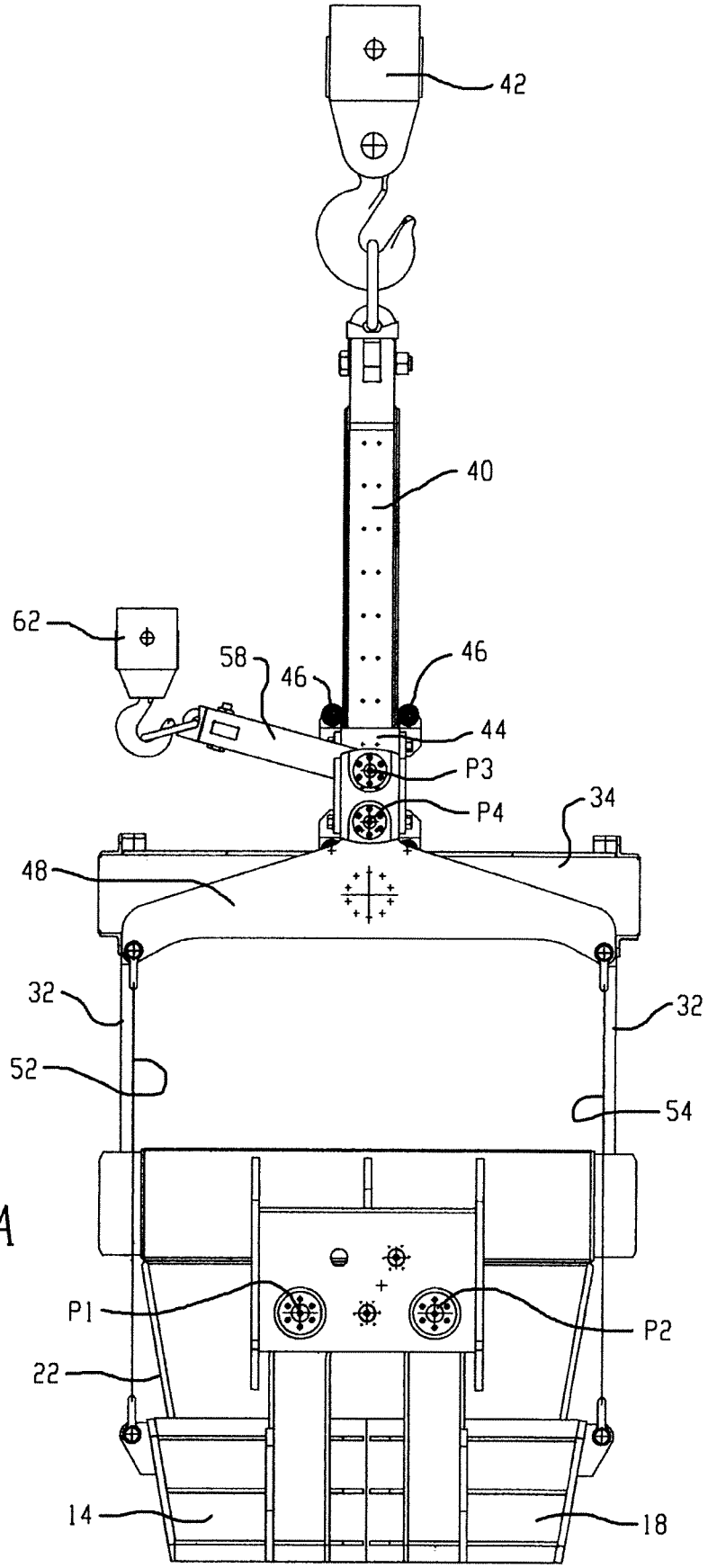
FIG. 2A is a front elevational view of the exemplary clamshell bucket of FIGS. 1A-1C in a suspended state with the clamshell halves closed in accordance with the present disclosure.
Figure 2B:
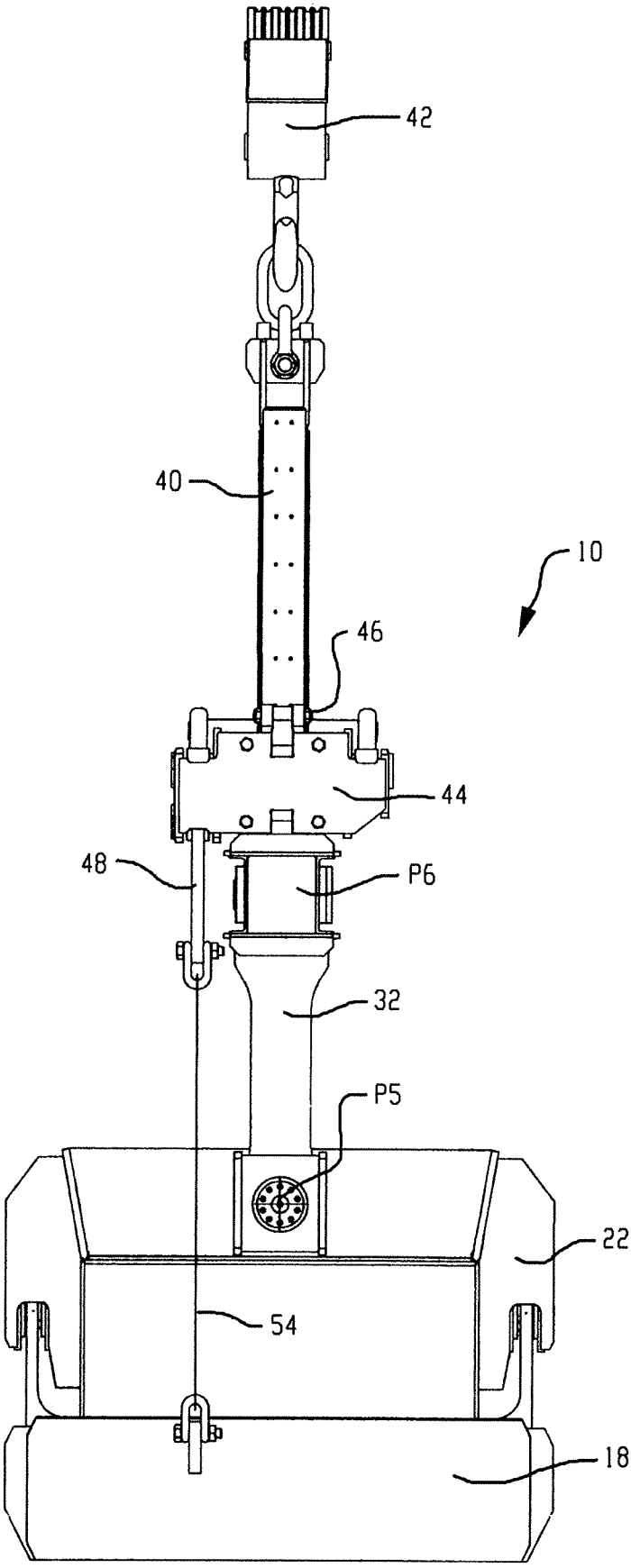
FIG. 2B is a side elevational view of the exemplary clamshell bucket of FIG. 2A.
Figure 2C:
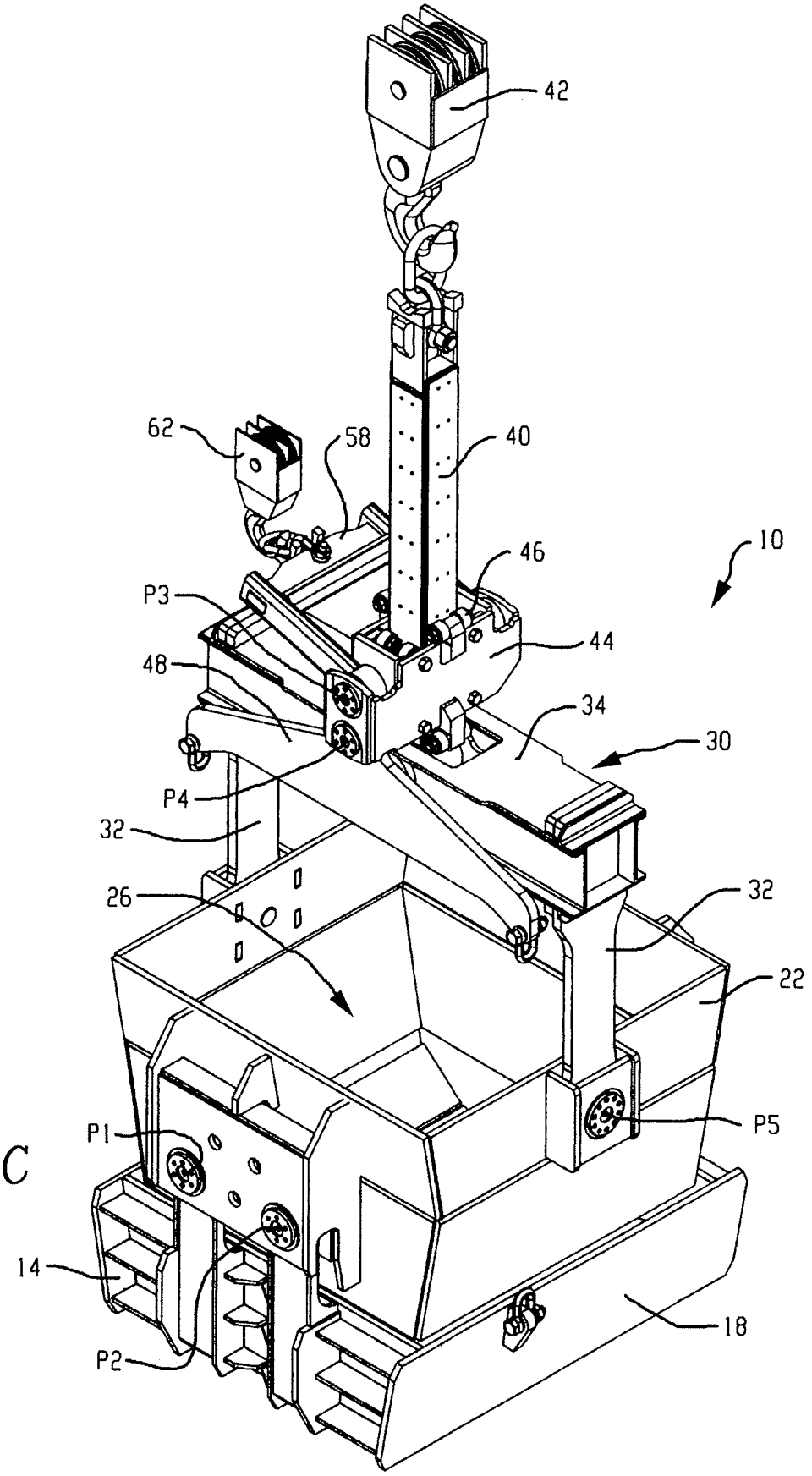
FIG. 2C is a perspective view of the exemplary clamshell bucket of FIG. 2A.
Figure 3A:
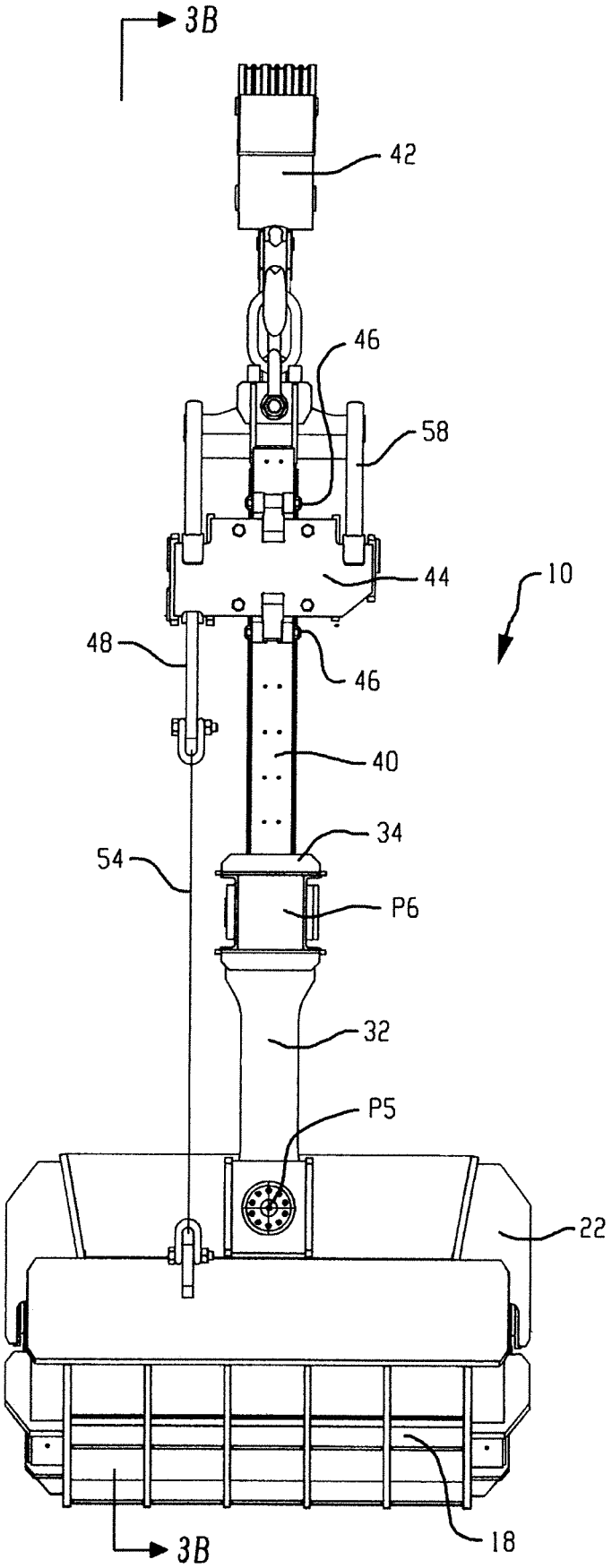
FIG. 3A is a side view of the exemplary clamshell bucket in a suspended state with the clamshell halves open during unloading of the bucket in accordance with the present disclosure.
Figure 3B:
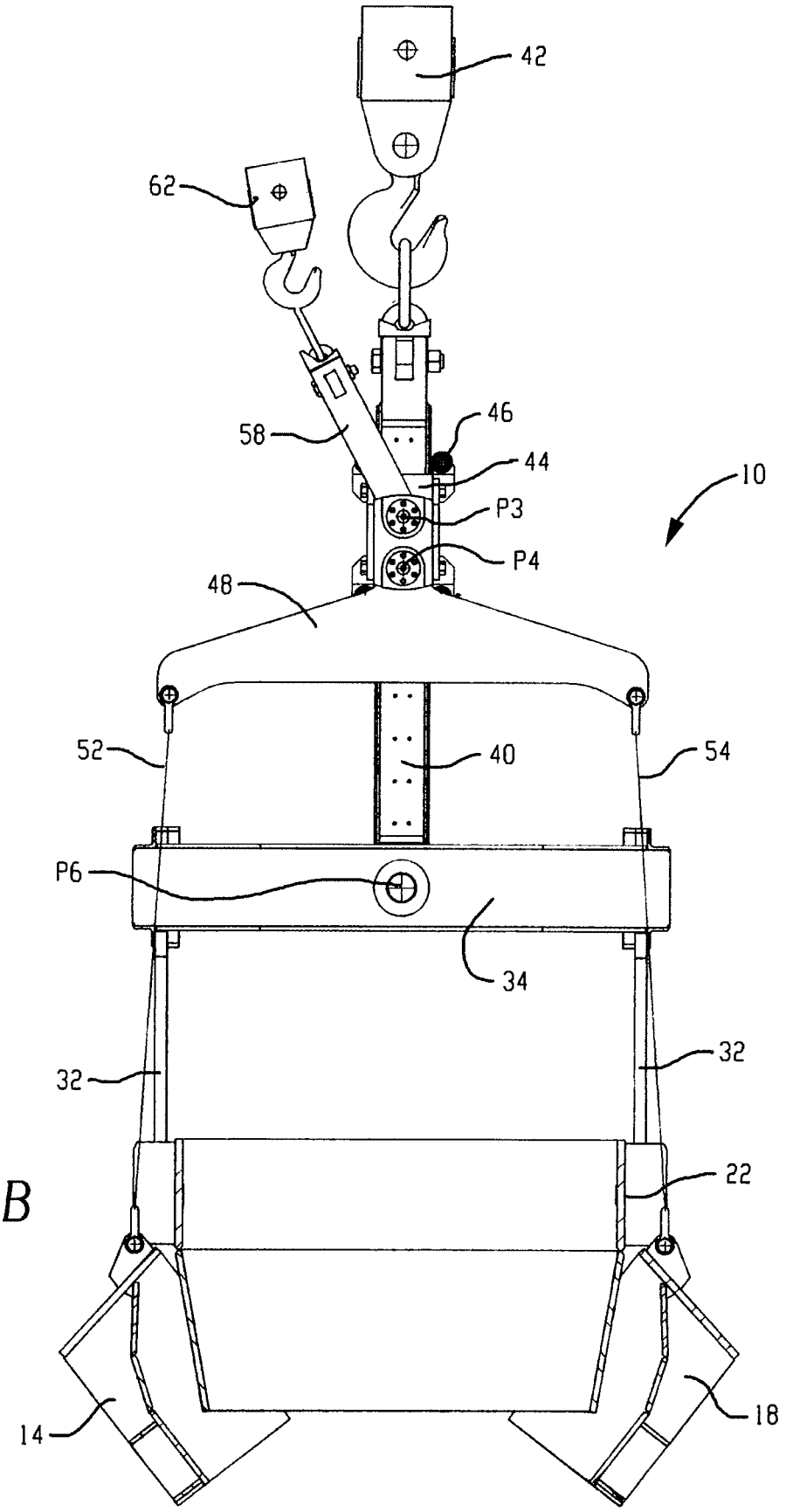
FIG. 3B is a cross-sectional view of the clamshell bucket taken along line 3B-3B in FIG. 3A.
Figure 3C:
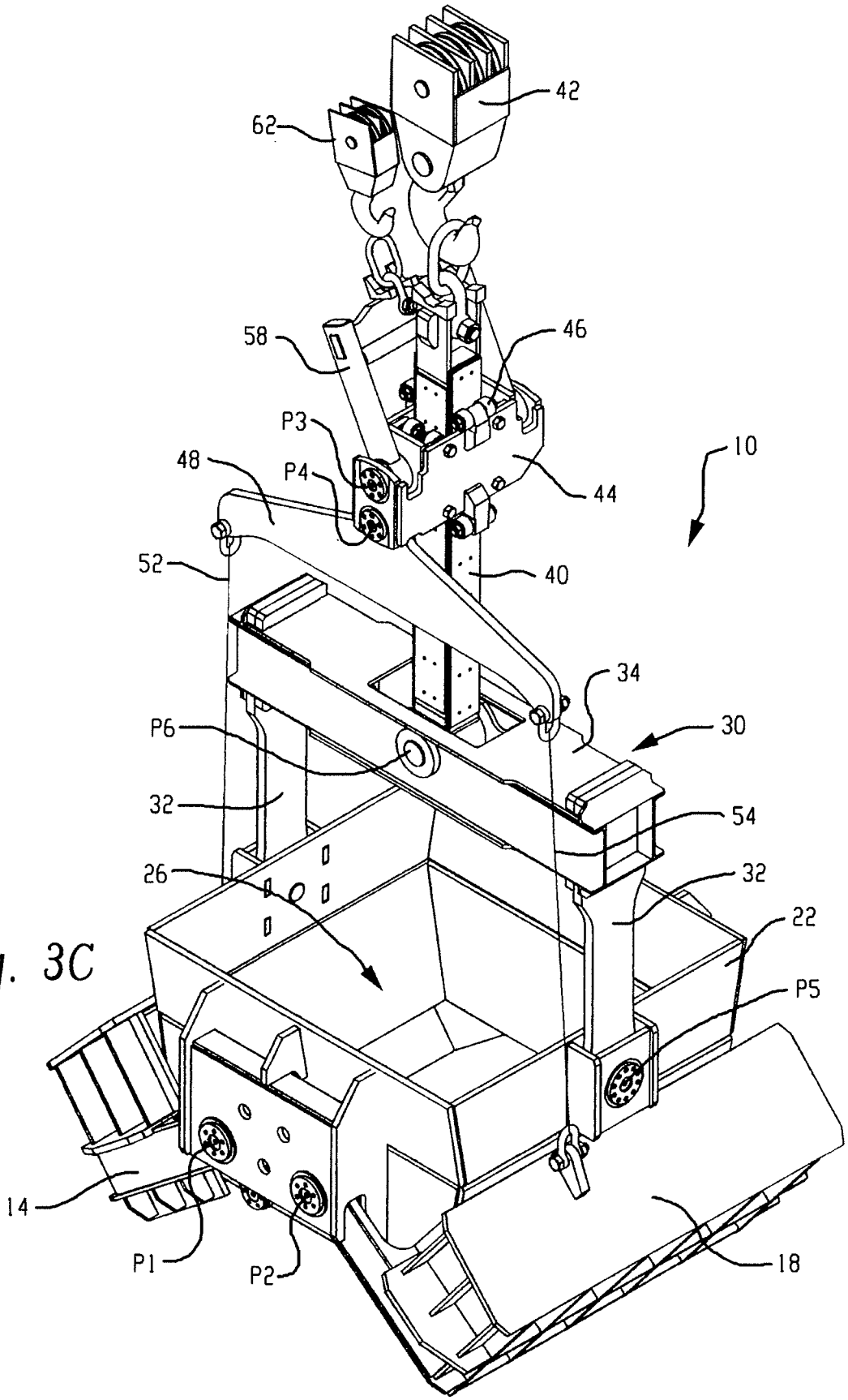
FIG. 3C is a perspective view of the clamshell bucket of FIG. 3A.

With additional reference to FIGS. 3A-3B, a pivot arm 58 is pivotally secured to the carriage 44 via pivots P3 and rotates from the position shown in FIGS. 1A-1C to the position shown in FIGS. 2A-2C when an auxiliary hook 62 initially applies a lifting force thereto, and rotates further to the position shown in FIGS. 3A-3C as the auxiliary hook 62 causes the carriage 44 to travel up the mast 40. The pivot arm 58 provides useful functionality in that it is relatively easily engaged by the auxiliary hook 62 when in the relaxed state as it naturally pivots away from the mast 40 for greater clearance. Upon engagement and lifting by the auxiliary hook 62, the pivot arm 58 pivots closer to the longitudinal axis of the mast 40 which tends to align the movement of the carriage 44 with the lifting axis of the auxiliary crane 62 for smoother, more efficient operation. In any case, cables 52 and 54 are generally drawn vertically along the same path regardless of the angle, orientation or position of the auxiliary hook with respect to the main hook and/or bucket 10.

It should be appreciated that pivot P4 associated with the aux-bail 48 allows the aux-bail 48 to pivot slightly during initial lifting to draw any slack from chains 52/54 prior to lifting. In addition, the mast 40 can pivot slightly with respect to the cross-member. The length of the mast 40 further adds stability to the assembly by lowering the center of gravity, with a longer mast generally providing a more stable configuration. Pivots P5 permit pivoting of the clamshell bucket receptacle 26 relative to the bail 30, while pivot P6 pivotally connects the mast 40 to the cross member 34.

In some embodiments, the carriage 44 may not need to travel the entire length of the mast 40 during unloading. In some embodiments, the pivot arm 58 can be located on different sides of the carriage assembly 44 than shown. In some embodiments, the carriage assembly 44 can be outfitted with more than one pivot arm, or the pivot arm can be located in a different location than illustrated in the exemplary embodiment, to facilitate connection to an auxiliary hook in more than one location. For example, the pivot arm 44 could be located on an opposite side of the mast 40.

Besides providing a more stable bucket and smoother operation, aspects of the present disclosure allow the bucket to maintain a more upright position by centering the mass of the aux-bail and related components closer to the vertical lift axis of the bucket (e.g., closer to the centerline of the mast), as compared to prior art buckets which exhibit tilt from the aux-bail being located further outboard.

It should now be appreciated that aspects of the present disclosure provide a clamshell bucket with aux-bail carriage with improved operation, particularly when an auxiliary hook is located in a less than desirable location or in a less than desirable orientation with respect to the clamshell bucket. Such situation may arise when utilizing existing crane installations in factories or plants. The carriage of the present disclosure normalizes movement of the aux-bail such that a much wider range of auxiliary hook positions and orientations can be utilized to open the bucket. This makes the clamshell bucket of the present disclosure more versatile as it can be used in a wider variety of existing crane installations while maintaining desired performance characteristics.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A clamshell bucket comprising:

a main body;

first and second clamshell portions pivotally secured to the main body and moveable between a closed position for loading a material in the clamshell bucket and an open position for dumping material from the bucket;

a bail coupled to the main body;

a mast connected to the bail and configured for attachment to an associated crane for lifting and/or transporting the clamshell bucket;

a release mechanism configured for attachment to an auxiliary crane for moving the clamshell portions from the closed position to the open position, the release mechanism including a carriage configured to translate along at least a portion of the mast from a location proximal the main body to a location distal the main body, the carriage being operatively connected to the first and second clamshell portions such that movement of the carriage away from the main body along the mast results in rotation of the clamshell portions toward the open position; and an aux-bail with first and second linkages extending from opposite ends of the aux-bail and coupled to the first and second clamshell portions, the aux-bail being supported by the carriage at a location between the first and second linkages.

2. The clamshell bucket of claim 1, wherein the aux-bail is pivotally connected to the carriage.

3. The clamshell bucket of claim 2, further comprising a pivot arm connected to the carriage, the pivot arm having a distal end adapted to be engaged by an associated auxiliary crane.

4. The clamshell bucket of claim 3, wherein the pivot arm is movable between a first position and a second position, wherein the distal end is spaced further from the mast in the first position than in the second position.

5. The clamshell bucket of claim 4, wherein the bail includes first and second arms pivotally attached to the main body, and a cross member extending between the first and second arms and connected to the mast, and wherein the aux-bail is coextensive with the cross member across a width of the main body.

6. The clamshell bucket of claim 5, wherein the mast is pivotally connected to the cross member.

7. The clamshell bucket of claim 1, wherein the carriage includes at least one roller.

8. A release mechanism configured for attachment to an associated auxiliary crane hook for moving respective clamshell portions of an associated clamshell bucket from a closed position to an open position, the associated clamshell bucket having a main body, first and second clamshell portions pivotally attached to the main body, and a mast extending from the main body for connection to a main crane hook, the release mechanism comprising:

a carriage mountable to the mast of the associated clamshell bucket for translating movement along at least a portion of the mast from a location proximal the main body of the bucket to a location distal the main body of the bucket, the carriage being operatively connectable to the first and second clamshell portions of the clamshell bucket such that movement of the carriage away from the main body along the mast results in rotation of the clamshell portions towards the open position; and an aux-bail with first and second linkages extending from opposite ends of the aux-bail and coupled to the first and second clamshell portions of the associated clamshell bucket, the aux-bail being supported by the carriage at a location between the first and second linkages.

9. The release mechanism of claim 8, wherein the aux-bail is pivotally connected to the carriage.

10. The release mechanism of claim 9, further comprising a pivot arm connected to the carriage, the pivot arm having a distal end adapted to be engaged by an associated auxiliary crane.

11. The release mechanism of claim 10, wherein the pivot arm is movable between a first position and a second position, wherein the distal end is spaced further from the mast of the associated clamshell bucket in the first position than in the second position.

12. The release mechanism of claim 11, wherein the carriage includes at least one roller.

13. A method of unloading a clamshell bucket comprising:

providing a clamshell bucket having a main body, first and second clamshell portions pivotally secured to the main body and moveable between a closed position for loading a material in the clamshell bucket and an open position for dumping material from the bucket, a bail coupled to the main body, a mast connected to the bail and configured for attachment to an associated crane for lifting and/or transporting the clamshell bucket, a release mechanism configured for attachment to an auxiliary crane for moving the clamshell portions from the closed position to the open position, the release mechanism including a carriage configured to translate along at least a portion of the mast from a location proximal the main body to a location distal the main body, the carriage being operatively connected to the first and second clamshell portions such that movement of the carriage away from the main body along the mast results in rotation of the clamshell portions toward the open position, and an aux-bail with first and second linkages extending from opposite ends of the aux-bail and coupled to the first and second clamshell portions, the aux-bail being supported by the carriage at a location between the first and second linkages; and causing said carriage to translate along said mast in direction away from the main body during an unloading process.

* * * * *